United States Patent [19]

Branke et al.

[11] 4,387,579

[45] Jun. 14, 1983

[54] BRAKE FOR A WARP KNITTING MACHINE

[75] Inventors: Walter Branke, Rodgau; Karl Winter, Obertshausen, both of Fed. Rep. of Germany

[73] Assignee: Karly Mayer Textilmaschinenfabrik GmbH, Fed. Rep. of Germany

[21] Appl. No.: 281,080

[22] Filed: Jul. 7, 1981

[30] Foreign Application Priority Data

Aug. 7, 1980 [DE] Fed. Rep. of Germany ..... 3025782

[51] Int. Cl.[3] ..... D04B 35/10

[52] U.S. Cl. ..... 66/157; 66/209; 66/210

[58] Field of Search ..... 66/209, 212, 203, 157

[56] References Cited

U.S. PATENT DOCUMENTS 3,961,500 6/1976 Braley et al. ..... 66/210

FOREIGN PATENT DOCUMENTS 2363411 7/1975 Fed. Rep. of Germany ..... 66/210

256022 10/1970 U.S.S.R. ..... 66/209

*Primary Examiner*—Ronald Feldbaum

*Attorney, Agent, or Firm*—Omri M. Behr

[57] ABSTRACT

A warp knitting machine has a main shaft driven by an electric motor which is powered by a main circuit. The machine has at least one supplemental, electrically driven arrangement for influencing the thread takeoff of the machine. This electrically driven arrangement is connected to the main circuit. Also included is an electrically operable brake coupled to the main shaft for braking it in response to interruption of the main circuit.

8 Claims, 2 Drawing Figures

BRAKE FOR A WARP KNITTING MACHINE

BACKGROUND OF THE INVENTION

1. Field of the Invention

The present invention relates to brakes for a warping knitting machine having a main and a supplemental drive arrangement and, in particular, to a brake that operates upon interruption of a main power circuit.

2. Discussion of the Relevant Art

The invention concerns warp knitting machines of the type wherein a main shaft is driven by an electric motor and which also has at least one electrically driven arrangement exercising control over a thread feed. The thread feed is connected to the same electrical circuit as the main motor.

In known warp knitting machines of this type (DEOS No. 2214862) the additional arrangement has an electrical regulating motor for maintaining the revolutions of the warp beam at a constant and predetermined speed for providing a constant feed rate of yarn. For this purpose, the warp beam is driven by the output of a differential (interference) drive having one input connected with the main beam and the other input connected with a control motor. The control motor is itself controlled by a regulating arrangement which measures the present value of the thread feed speed and compares it with the desired value. It has already been suggested (German patent application No. P2904367) to employ, as an additional arrangement, an electromagnetic system for presetting a jacquard arrangement. In this case, every jacquard controlled guide cooperates with an electromagnet whose moveable core at a particular point in the machine cycle stops together with the controlled guide or leaves it free for further movement.

Heretofore, in the case of power failure, the electrically powered supplemental drive arrangements stop immediately while the main shaft, having a high speed and mass continues to rotate. This difference in deceleration occurs especially when the two systems are not mechanically linked. While continued rotation time is less than a second, when the machine is operating in the order of 1,600 to 2,000 revolutions per minute, this corresponds to approximately 20 courses. Thus a power break of less than a second, which occurs occasionally in modern power circuits and quite frequently in the power circuits of less developed countries, can lead to quite substantial faults in the ware. Thus, for example, when the warp beam is driven by means of a control motor, the warp beam will immediately be halted at power failure while the main shaft will continue to run. This means, in effect, that all of the warp threads will be torn. Also at the onset of a power failure, when the electromagnets of a jacquard arrangement no longer receive any more power, no patterning will occur. Thus, over a substantial portion of the goods, a clearly noticeable strip of improper patterning will be seen.

Also, a known knitting machine employs a main beam with an electrically activated brake. This brake, however, goes into its braking position on the application of power and merely serves to halt the main beam at a particular point in its cycle of rotation (U.S. Patent 2,779,448).

SUMMARY OF THE INVENTION

Therefore, it is one object of the present invention to provide a brake for properly halting a knitting machine when its electrical power is interrupted.

Another object of the present invention is to provide a warp knitting machine of the heretofore described type for avoiding errors which embrace the whole width of the machine.

It is still a further object of the present invention to provide a brake for the main shaft which, when the power fails, automatically falls into the braking position.

A warp knitting machine according to the principles of the present invention has a main shaft driven by an electric motor which is powered by a main circuit. The machine has at least one supplemental, electrically driven arrangement for influencing the thread takeoff of the machine. This electrically driven arrangement is connected to the main circuit. Also included is an electrically operable brake means coupled to the main shaft for braking it in response to interruption of the main circuit.

BRIEF DESCRIPTION OF THE DRAWINGS

In order that the invention may be fully understood, it will now be described, by way of example, with reference to the accompanying drawings in which.

DESCRIPTION OF THE PREFERRED EMBODIMENT

Figure 1:
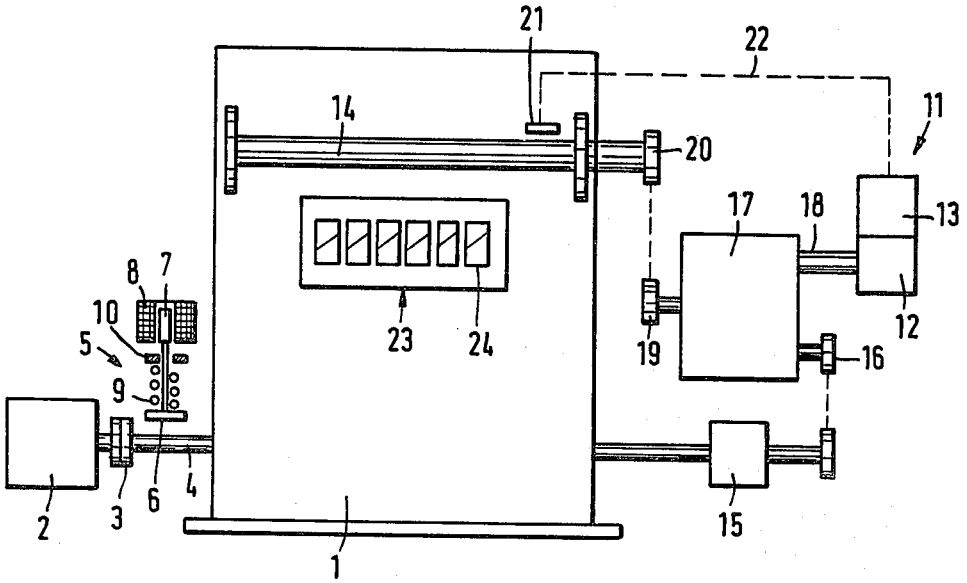
FIG. 1 is a schematic representation of a warp knitting machine according to the teachings of the present invention.

Referring to FIG. 1, a warp knitting machine 1 of a conventional design is schematically illustrated only to an extent essential for an understanding of the present invention. An electrically activated drive motor 2 drives main shaft 4 through coupling 3 for driving one or more warp knitting machines. A brake means 5 is shown as braking element 6 which can engage either directly or indirectly the appropriate portion of main shaft 4 to resist its rotation. Braking element 6 has a rod linked to an electromagnet means 8 at its moveable core 7. Braking spring 9, in the form of a helical compression spring is positioned between braking element 6 and stationary support surface 10 to bias element 6 against shaft 4. Electromagnet 8 can be energized to draw in its core 7 to compress spring 9 and disengage brake element 6 so shaft 4 is free to rotate. The spring constant and size of spring 9 is such that if electromagnet 8 is not energized brake element 6 engages shaft 4 with a force to be described presently.

In this preferred embodiment of the invention, the power of the brake is sized so that after engagement the number of permitted rotations of main shaft 4 is not more than 0.5% of the normal number of revolutions in one minute. In this particular preferred embodiment, this allowed revolution is set to be no more than 1 or 2 revolutions at shaft speeds of 1,600 to 2,000 revolutions per minute.

A first supplemental, electrically driven arrangement 11 comprises a regulating motor 12 with the appropriate electrical control arrangement 13 to insure that warp beam 14 runs with the predetermined thread takeoff speed. To drive beam 14, the main drive shaft 4 is coupled through a reduction gear train 15 to the input 16 of a differential drive 17, whose other input 18 connects to the output shaft of regulating motor 12. The output 19 of differential drive 17 drives beam 14 at its input 20 through a drive train suggested by the interconnecting dotted line.

A sensor 21 provides the signal indicating the actual speed of rotation of warp beam 14 for controlling arrangement 13 via lead 22. The actual rate of rotation is there compared to the desired rate of rotation which then causes regulating motor 12 to run at such a speed that under the influence of input 16, output 19 rotates at a speed sized to keep the yarn feed rate of warp beam 14 constant.

A second, additional, supplemental drive may be formed by the presetting arrangements of a jacquard system 23. In this case, a row of electromagnets 24 can each act upon the steering control arrangement for each of the moveable thread guides (not shown).

It will be appreciated that upon power failure motor 2 and 12 will cease turning but motor 2, being connected to a more massive system, would tend to continue turning longer if not braked, in a manner described hereinafter.

Figure 2:
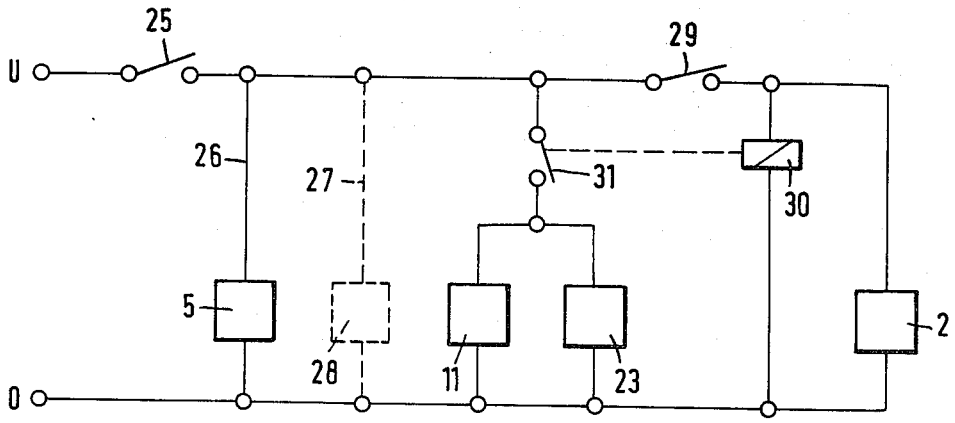
FIG. 2 is a schematic diagram associated with the machine of FIG. 1.

FIG. 2 is a simplified circuit diagram for the warp knitting machine of FIG. 1. The main circuit is connected between the power mains U and O which are the high tension and ground terminal, respectively. The main circuit to the entire machine may be interrupted by main switch 25. The braking circuit 26 for brake 5 branches off behind this main switch 25. Thus, switch 25 and brake 5 are serially connected between terminals U and O. Other working circuits, for example circuit 27, for other continually running arrangements such as a heater can also be coupled in. Accordingly, heater 28 is shown connected in parallel with brake 5. By means of a working switch 29, previously illustrated main motor 2 can be switched in and out independently of the main switch 25, provided, of course, main switch 25 is closed. Motor 2 and switch 29 are shown serially connected between terminal O and the junction of brake 5 and switch 25. Connected in parallel with motor 2 is coil 30 of a time delay relay which can close normally open contacts 31 when coil 30 is energized and can open, after a predetermined delay, contacts 31 when coil 30 is not energized. Previously illustrated supplemental drive arrangements 11 and 23 are connected in parallel between terminal O and one terminal of switch 31, whose other terminal connects to the junction of switches 25 and 29. Being thus connected, the supplemental drives 11 and 23 can run on after motor 2 is disconnected but the main shaft continues turning due to its inertia.

In a normal operation of the system, the main switch 25 is closed to lift brake 5 and disengage shaft 4 (FIG. 1). The machine is set into operation by closing switch 29 to power main motor 20, control motor 11 and jacquard arrangement 11.

When working switch 29 is opened, the warp knitting machine runs quietly to a stop because, although power is immediately removed from main motor 2 which then coasts, the delay in opening switch 31 keeps power on the supplemental drives 11 and 23. This means that warp beam 14 still runs on and the electromagnets 24 are still correctly controlled, all in synchronism with main shaft 4. This leads to failure free goods. Also, since switch 25 has not been opened, brake 5 was not engaged to stop machine 1, thereby reducing brake wear.

A sequence will now be considered where power is applied but then fails. When power is initially applied to terminals U and O, assuming switch 25 is then closed, the coil of electromagnet 8 is energized, causing core 7 (FIG. 1) to draw brake element 6 away from main shaft 4 as spring 9 is compressed. When brake element 6 is thus retracted into this compressed position, braking energy has been stored in spring 9. As discussed previously, motor 2, warp drive 11 and jacquard arrangement 23 are also energized, assuming switch 29 is closed.

Assume now that the power at terminals U and O is removed due to the fault of the utility, the opening of switch 25 or some other cause. Consequently, not only is the main drive motor 2 immediately turned off, but power is removed from the supplemental drive means 11 and 23. This, however, does not cause any problems since simultaneously brake 5 is deprived of power, causing spring 9 to drive element 6 into its braking position whereby the main shaft is brought to a rapid halt. In this embodiment, main shaft 4 is causing machine 1 to cycle 1,600 to 2,000 times per minute. When brake element 6 is engaged, however, shaft 4 quickly declerates and continues to turn less than two revolutions before stopping completely. For practical purposes, therefore, main shaft 4 has stopped substantially immediately. Furthermore, the warp beam 14 experiences substantially the same deceleration. However, beam 14 decelerates not because of a brake but because of the work load on warp beam 14 resisting its movement. Moreover, unlike main shaft 4, beam 14 is not connected to relatively massive components that would tend, simply by inertia, to sustain rotation beyond two revolutions.

Accordingly, through this shortening of post-failure time (coasting) the occurrence of faults is substantially eliminated. The post-failure number of courses can be kept so small that the usual thread reserve is sufficient and the pattern fault is so small that it cannot be noticed optically. This feature also prevents thread breakage.

Hereinbefore has been disclosed an effective device for stopping a knitting machine by a switch or at a power failure, without causing noticeable faults. While it is desirable to branch the braking current circuit off after the main switch of the machine power circuit, other configurations are possible. It is preferable, however, to arrange the braking system so the brake is always ready to operate as soon as the main switch is activated. Thus the brake can be used not only for power failures but for emergency stoppage of the machine, as well. While it is advantageous to provide that the supplemental drive system may be switched off via a time delay switch which opens with a delay relative to the working switch, in other embodiments, this feature can be eliminated or can be accomplished by an alternate timing circuit or by a second brake. Also, while the foregoing embodiment shows the machine being normally turned off without the assistance of the brake, in embodiments where brake wear is not a concern the brake can be routinely engaged by operating the working switch to stop the machine. Any known electrically operable brake may be employed. Thus, there may be employed disc brakes or drum brakes. These brakes can act directly on the motor or on a portion of the construction directly driven by the main shaft. Generally speaking, the main shaft of each warp knitting machine may have one or a plurality of warp beams each provided with a supplemental drive means. This invention is particularly useful for high capacity machines having a rate of rotation of 1,600 to 2,000 RPM since the effect of power failure in these machines is particularly serious, but faster or slower machines may also be served by this invention. Therefore, it will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention what is claimed is:

1. A warp knitting machine having a main shaft driven by an electric motor powered by a main circuit, further comprising:

(a) at least one supplemental, electrically driven regulating motor for influencing the thread takeoff of said machine, said electrically driven regulating motor being connected to said main circuit; and (b) electrically operable brake means coupled to said main circuit operable upon said main shaft for braking in response to interruption of said main circuit.

2. A warp knitting machine according to claim 1 wherein said brake means comprises:

(a) a braking spring; and (b) electromagnetic means operable to oppose the force of said braking spring.

3. A warp knitting machine according to claim 1 further comprising:

a main switch serially connected between said main circuit and said electric motor for interrupting said main circuit.

4. A warp knitting machine according to claim 3 further comprising:

(a) a working switch serially connected between said main switch and said electric motor;

(b) a timed delay switch serially connected between said main circuit and said supplemental arrangement for interrupting power to the latter after a predetermined delay, in response to opening of said working switch.

5. A warp knitting machine according to claim 1 wherein the braking power of said brake means is sized to stop the cycling of said machine and allow the elapsing of fewer than 0.5% of the cycles otherwise occurring in one minute before stopping said main shaft.

6. A warp knitting machine according to claim 5 wherein said braking power of said braking means is sized to stop the cycling of said machine and prevent said main shaft from revolving more than twice after engagement of said braking means.

7. A warp knitting machine according to claims 1, 4 or 5 wherein said machine includes a warp beam and wherein said supplemental regulating motor comprises:

a control motor for driving said warp beam.

8. A warp knitting machine according to claim 1 wherein said machine includes a warp beam and a jacquard arrangement and an electromagnetic arrangement for presetting said jacquard arrangement wherein said supplemental regulating motor arrangement comprises:

(a) control motor for driving said warp beam.

* * * * *